US006446705B2

(12) United States Patent
Geltser et al.

(10) Patent No.: US 6,446,705 B2
(45) **Date of Patent: *Sep. 10, 2002**

(54) METHOD AND APPARATUS FOR MANIPULATING AN ELECTRODE

(75) Inventors: Ilia S. Geltser, Pittsburgh, PA (US); Mitchell D. Tyson, Monroe, NC (US)

(73) Assignee: ATI Properties, Inc., Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/886,674

(22) Filed: Jun. 21, 2001

Related U.S. Application Data

(63) Continuation of application No. 09/330,950, filed on Jun. 11, 1999, now Pat. No. 6,273,179.

(51) Int. Cl.[7] ..... B22D 27/02; H05B 7/10

(52) U.S. Cl. ..... 164/495

(58) Field of Search ..... 164/470, 495, 164/496, 497, 508, 509, 514, 515; 75/10.23, 10.24; 266/201; 373/92, 98, 99, 100

(56) References Cited

U.S. PATENT DOCUMENTS

| | | | |
|---|---|---|---|
| 3,650,311 | A | 3/1972 | Fritsche |
| 3,752,216 | A | 8/1973 | Fritsche |
| 4,498,521 | A | 2/1985 | Takeda et al. |
| 4,567,935 | A | 2/1986 | Takeda et al. |

FOREIGN PATENT DOCUMENTS

| | | |
|---|---|---|
| DE | 402867 | 9/1924 |
| DE | 134 604 | 3/1979 |
| DE | 3629043 A1 | 7/1987 |
| EP | 0 114 309 A1 | 8/1984 |
| FR | 1075052 | 10/1954 |

*Primary Examiner*—Kuang Y. Lin
(74) *Attorney, Agent, or Firm*—Patrick J. Viccaro

(57) ABSTRACT

An apparatus and associated method for manipulating an electrode comprising a stub, an electrode, and a yoke. The stub is affixed to and protrudes from the electrode, and has a first opening. The yoke is sized to receive at least a portion of the stub, and has a second opening positioned for alignment with the first opening of the stub and receipt of a locking member extending through the first opening and the second opening. The apparatus may include a current conducting tube. The elongated yoke may extend around at least a portion of the stub to be removably pinned thereto. The current conducting tube may extend around the elongated yoke to be in electrical contact with the stub.

17 Claims, 4 Drawing Sheets

METHOD AND APPARATUS FOR MANIPULATING AN ELECTRODE

CROSS REFERENCE TO RELATED APPLICATIONS

This application is a continuation of application Ser. No. 09/330,950, filed Jun. 11, 1999 now U.S. Pat. No. 6,273,179.

BACKGROUND OF THE INVENTION

1. Field of the Invention

The present invention is directed, generally, to continuous metal casting, and more particularly to a method and apparatus for electrode or metal ingot casting.

2. Description of the Invention Background

Over the years, a variety of methods and improvements have been developed for casting metal electrodes and ingots. An electrode essentially comprises a solid cast metal block that is formed to be remelted and cast into an ingot, or into a certain geometric form. To accomplish the remelting of the electrode, an appropriate amount of electrical current is applied to the electrode utilizing known techniques and process controls. Thus, an electrode is essentially an intermediate product used in metal casting processes and an ingot is a finished product that is usually subsequently subject to mechanical deformation, such as forging or rolling.

Metal electrodes may be formed utilizing a variety of casting processes. For example, electrodes may be continuously casted in a vertically oriented process wherein the electrode is cast into a stationary mold from plasma arc, electron beam, vacuum induction, skull induction, skull or ac furnaces.

FIGS. 1–4 illustrate the conventional dovetail assembly and electrode forming process in vertical continuous casting. Conventional continuous casting of steel and titanium electrode melting in electron beam, plasma arc or skull furnaces typically uses a supporting mechanism, such as a cylindrical block 2, that is machined to include a dovetail 3. The cylindrical block 2 is detachably engaged to side wall 4 to form a vertical continuous casting vessel 5.

During vertical continuous casting, molten metal is introduced into, and fills, the vessel 5. Because the cylindrical block 2 is made from a conductive metal, the cylindrical block 2 conducts heat away from the molten mass, and thereby encourages solidification near the bottom of the vessel 5. As is common in continuous casting, the cylindrical block 2 is detached from the side wall 4 and is mechanically moved downward to grow the electrode column length. As the cylindrical block 2 moves downward, molten metal is continually added into the vessel 5 to maintain the liquid level of the molten metal at the top of the side wall 4. Typically, a heat source is used near the top of the vessel 5 to provide additional heat in this area for maintaining the molten mass in the molten state and preventing premature solidification. The dovetail 3 locks the electrode to the cylindrical block 2, as the block 2 moves downward. Through this process, for example, an electrode of approximately 15,000–25,000 pounds may be produced. The electrode is then laterally removed from the dovetail 3 and released from the cylindrical block for further processing.

As the cylindrical block 2 moves downward, however, streaks of molten metal may run down along the surface of the electrode and form icicle-like formations or "rundowns" over the sides of the dovetail 3. These "rundowns" can act as a latch that prevents removal of the electrode from the cylindrical block 2. Accordingly, these "rundowns" must be chiseled from the dovetail 3 so that the electrode can be withdrawn from the block 2.

Furthermore, such process generally provides a cast electrode that has a relatively uneven surface that is not well suited for uniform adhesion to other flat surfaces, such as a conducting solid cylinder which is used to introduce current into the electrode during the re-melting process. Thus, during subsequent vacuum arc or electroslag re-melting, introduction of current into or through the cast surface on many occasions causes arcing that results in damage to the re-melting equipment. A massive plunge/stub must be welded to one end of the electrode. The plunge/stub has a smooth surface and is used both to support the electrode weight and to introduce current into it. FIG. 4 illustrates the conventional electrode assembly wherein an electrode 6 is welded to the solid conducting stub 7 for subsequent re-melting of the electrode through the application of a current thereto through the conducting stub 7.

The need to mechanically remove the "rundowns" from the cylindrical block and the additional welding processes add a significant amount of time and cost to the continuous casting process. Accordingly, a continuous casting locking mechanism and electrode assembly is needed that eliminates these additional process steps to increase manufacturing time and efficiency.

BRIEF SUMMARY OF THE INVENTION

The present invention addresses the above-mentioned needs by providing an apparatus for manipulating an electrode and associated method.

In one form of the invention, the apparatus comprises a stub, an electrode, and a yoke. The stub is affixed to and protrudes from the electrode, and has a first opening. The yoke is sized to receive at least a portion of the stub, and has a second opening positioned for alignment with the first opening of the stub and receipt of a locking member extending through the first opening and the second opening.

In another embodiment, the apparatus of the present invention comprises a stub, an electrode, a yoke, and a current conducting tube. The stub protrudes from the electrode and is affixed thereto. The elongated yoke extends around at least a portion of the stub and is removably pinned thereto. The current conducting tube extends around the elongated yoke and is in electrical contact with the stub.

The present invention also provides a method for manipulating and applying an electrical current to an electrode. A stub having a first opening is affixed to the electrode. A yoke is removably attached to the stub such that a second opening of the yoke and the first opening of the stub may receive a locking member when the first opening and the second opening are aligned. An electricity conducting path is established between the stub and a source of electricity.

The present invention also provides a method for manipulating an electrode. A stub is affixed to the electrode. An elongated yoke is extended around at least a portion of the stub, and removably pinned thereto. A current conducting tube is extended around the elongated yoke such that the current conducting tube is in electrical contact with the stub.

BRIEF DESCRIPTION OF THE SEVERAL VIEWS OF THE DRAWING

The characteristics and advantages of the present invention may be better understood by reference to the accompanying drawings, wherein like reference numerals designate like elements and in which.

DETAILED DESCRIPTION OF THE INVENTION

Figure 1:
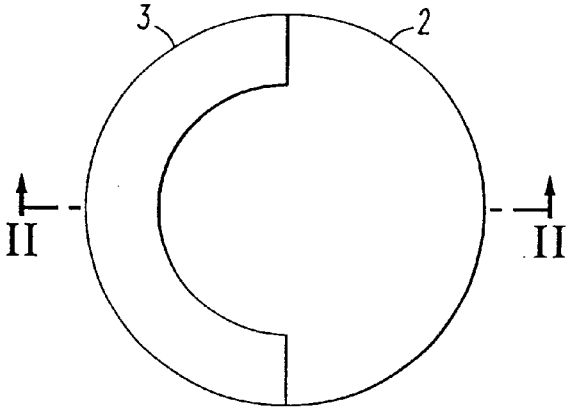
FIG. 1 PRIOR ART
FIG. 1 is a top view of a prior art electrode support mechanism and dovetail.
Figure 2:
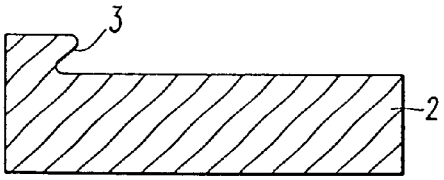
FIG. 2 PRIOR ART
FIG. 2 is a cross-sectional view of the prior art support mechanism and dovetail of FIG. 1 taken along line II—II in FIG. 1.
Figure 3:
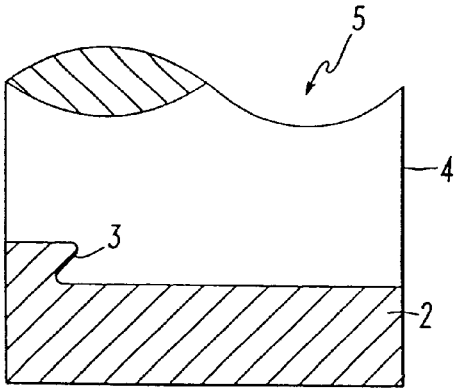
FIG. 3 PRIOR ART
FIG. 3 is a cross-sectional view of the of an electrode formed in a convention mold incorporating the support mechanism and dovetail of FIG. 1.
Figure 4:
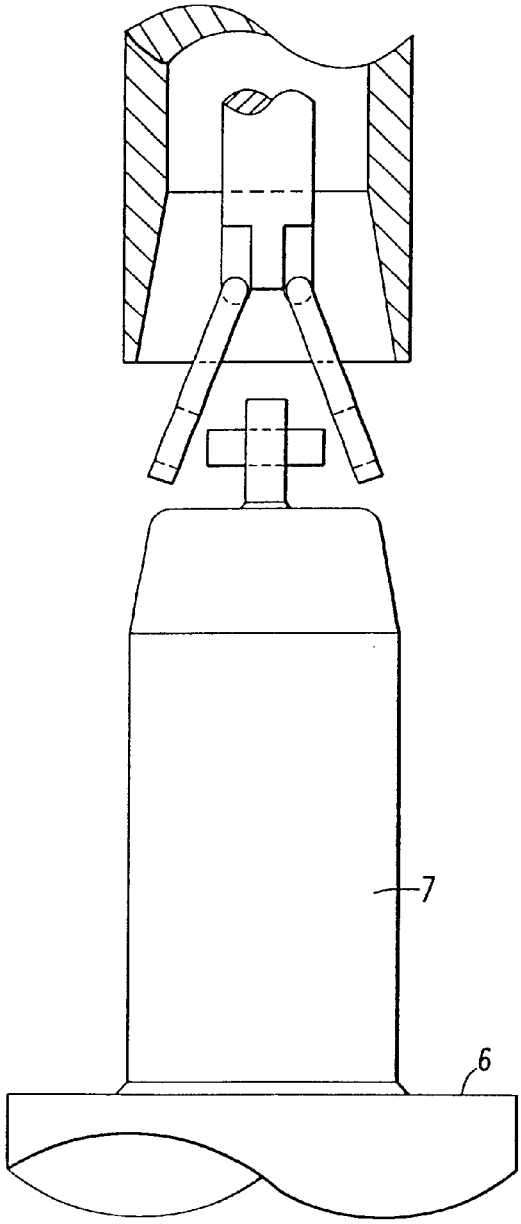
FIG. 4 is a cross-sectional view of prior art electrode assembly.

It is to be understood that the Figures and descriptions of the present invention have been simplified to illustrate elements that are relevant for a clear understanding of the present invention, while eliminating, for purposes of clarity, other elements. Those of ordinary skill in the art will recognize that other elements may be desirable in order to implement the present invention. However, because such elements are well known in the art, and because they do not facilitate a better understanding of the present invention, a discussion of such elements is not provided herein.

In the present Detailed Description of The Invention, the invention will be illustrated in the form of a metal electrode or ingot assembly having a particular configuration. To the extent that this configuration gives size and structural shape to the electrode assembly, it should be understood that the invention is not limited to embodiment in such form and may have application in whatever size, shape, and configuration of electrode assembly desired. Thus, while the present invention is capable of embodiment in many different forms, this detailed description and the accompanying drawings disclose only specific forms as examples of the invention. Those having ordinary skill in the relevant art will be able to adapt the invention to application in other forms not specifically presented herein based upon the present description.

Also, the present invention and devices to which it may be attached may be described herein in a normal operating position, and terms such as upper, lower, front, back, horizontal, proximal, distal, etc., may be used with reference to the normal operating position of the referenced device or element. It will be understood, however, that the apparatus of the invention may be manufactured, stored, transported, used, and sold in orientations other than those described.

The terms "ingot" and "electrode," as used herein, describe essentially the same solid cast metal block. However, United States import classification characterizes an "electrode" of metal as an intermediate product, which will be further re-melted and cast into an "ingot," or into a part of certain geometry. The term "ingot" typically refers to finished products that are subject to mechanical deformation such as forging or rolling. For clarity, however, the term "electrode" will be used throughout the present detailed description to describe either the unfinished or finished solid cast metal block of the present invention.

The present invention is generally directed to application in vertical continuous electrode casting into a stationary mold from plasma arc, electron beam, vacuum induction, skull induction, skull or arc furnace, and the like, and to static electrode casting into a stationary mold with a stationary electrode. The electrode of the present invention may be used in an electrode assembly for engagement with a furnace ram for further re-melting. One skilled in the art will appreciate, however, that the present invention may be incorporated into other continuous metal casting processes not particularly identified herein.

Figure 5:
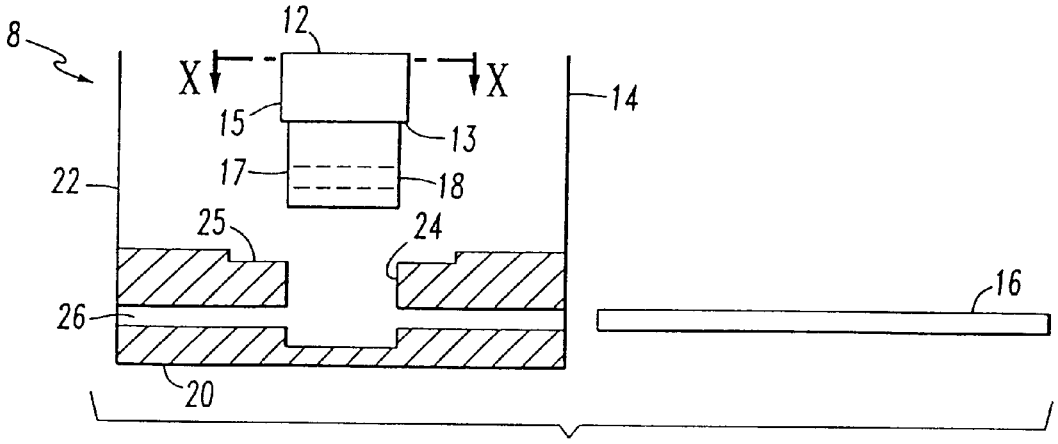
FIG. 5 is an exploded cross-sectional view of one embodiment of the present invention illustrating the locking assembly of the present invention.
Figure 6:
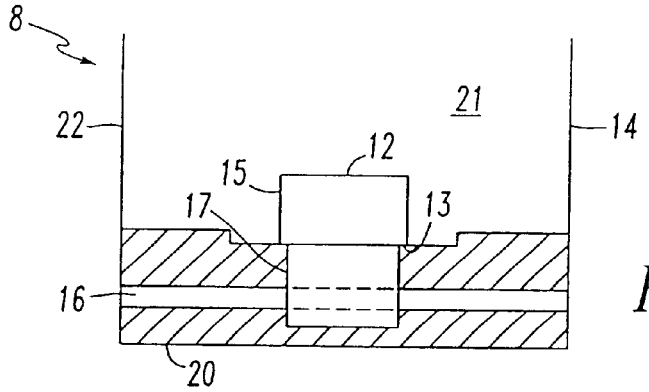
FIG. 6 is a cross-sectional view of the locking assembly of the present invention.
Figure 7:
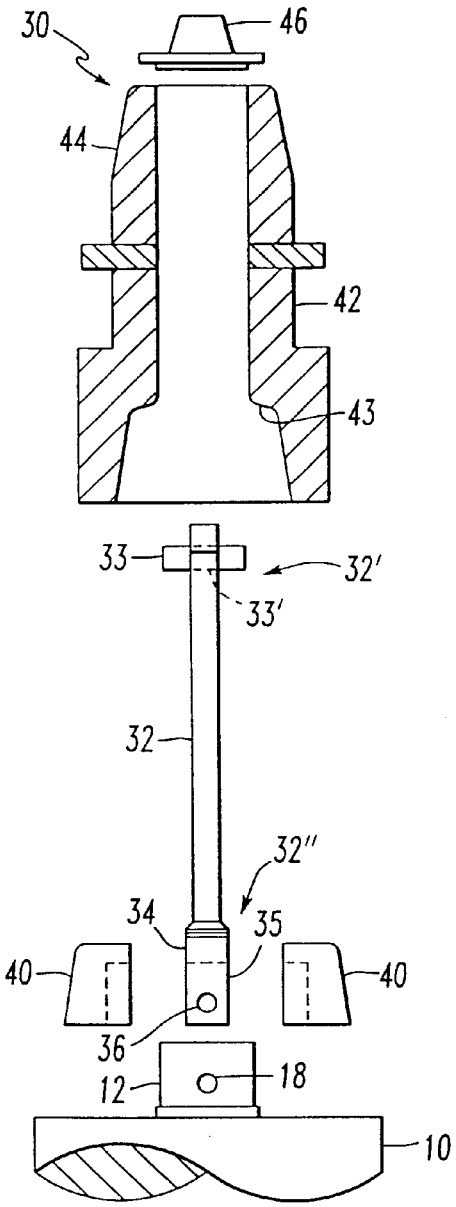
FIG. 7 is an exploded cross-sectional view of one embodiment of the electrode assembly of the present invention.

Turning now to the drawings, FIGS. 5 and 6 are cross-sectional views of one form of the electrode locking assembly 8 of the present invention comprising a sacrificial stub 12, a mold 14, and a locking member 16 for forming an electrode 10 (FIG. 7).

The stub 12 may be a solid metallic block formed by any means known in the art such as, for example, by casting of machining. The stub 12 may be any shape, such as, for example, a cylindrical block having a circular cross-section taken along the x-axis and a rectangular cross-section taken along the y-axis, as illustrated. The stub 12 may have a slight offset 13 that separates a top portion 15 from an inset portion 17. The material that forms the stub 12 should be compatible with the metal that forms the electrode 10. For example, for an electrode fabricated from a titanium alloy, the stub 12 may comprise the same titanium alloy. The stub 12 includes a first transverse opening 18 passing through the inset portion 17. The first opening 18 may be machine-drilled or cast. When the stub 12 is a cylindrical block, the first opening 18 may be a radial opening passing through the stub's center.

The mold 14 may be an open ended vertical continuous casting vessel for forming the electrode 10. The mold 14 includes a bottom block portion 20 and side walls 22. The bottom block 20 is a support member for the forming electrode 10 and may be formed of any heat conductive material that conducts heat away from the molten metal, while also preventing the fusion of molten metal thereto. Some metals that may comprise the bottom block 20 are, for example, copper, gold, or silver. The bottom block 20 may be any shaped block such as, for example, a cylindrical block and cooperates with the side walls 22 to initially form a mold cavity 21 within the mold 14. The bottom block 20 includes a recessed portion 24 having a counterbored portion 25. The recessed portion 24 and the counterbore 25 are typically centrally positioned from the outer edge of the bottom block 20. The recessed portion 24 may be any shape or configuration that mates with the shape or configuration of the stub 12, such as, for example, a cylindrical recess, and may be sized slightly larger than the inset portion 17 of the stub 12 so that the inset portion 17 can be received therein. The bottom block 20 includes a second opening 26 passing through the recessed portion 24. The second opening 26 may be any shape or configuration, and may be, for example, a radial cylindrical opening passing through the diameter of the bottom block 24 when the bottom block 20 is a cylindrical block. The second opening 26 is configured such that when the stub 12 is received into the recessed portion 24 of the support mold 14, the second opening 26 may be positioned in alignment with the first opening 18 of the stub 12.

The locking member 16 may be a solid metal member having a length approximately, but not necessarily, equal to the width of the bottom block 20 of the mold 14. The locking member 16 may be a rod, plate, pin, bar, screw, bolt, clasp, clip, or other fastener that is sized to be received into the first opening 18 of the stub 12 and the second opening 26 of the mold 14 to lock the stub 12 to the mold 14. The locking member 16 may be any metal or metal alloy suitable for use with the stub 12, such as, for example, titanium, mild carbon steel, or hardened carbon steel.

It is contemplated that the components that form the electrode locking assembly 8 may have dissimilar shapes. For example, it is contemplated that the bottom block 20 may have a recessed portion 24 having a rectangular cross-section and the stub 12 may be a cylinder having a circular cross-section. Likewise, the first and second openings 18, 26, respectively, may have a rectangular cross-section and the locking member 16 may be cylindrical rod having a circular cross-section. If the components have dissimilar shapes, an adapter or the like (not shown) may be used between components to limit their movement and provide a secure fit therebetween.

It is also contemplated that the stub 12 and the bottom block 20 of the mold 14 may have more than one opening passing therethrough to provide additional locking strength therebetween. If additional openings are present, each opening in the stub 12 will typically have a corresponding opening to, and be in alignment with, an opening in the bottom block 20 for receipt of a corresponding locking member 16.

Figure 6A:
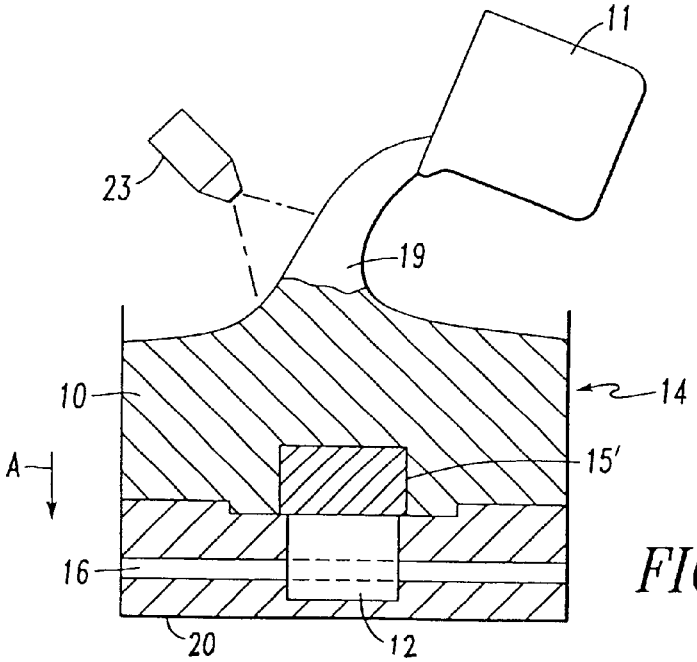
FIG. 6A is another cross-sectional view of the locking assembly and mold showing molten material being introduced into the mold to form an electrode.

To form the electrode 10 of the present invention, the stub 12 is lowered into the recessed portion 24 of the mold 14 and positioned such that the first opening 18 in the stub 12 corresponds to, and is in relative alignment with, the second opening 26 in the bottom block 20. The stub 12 is secured to the mold 14 by inserting the locking member 16 through the second opening 26 and the first opening 18, thereby locking the stub 12 to the mold 14. See FIG. 6. Molten metal 19 is then introduced from a source 11 into the mold 14 and around the stub 12. See FIG. 6A. The heat from the molten metal 19 liquefies at least a part 15' of the top portion 15 of the stub 12 so that the metal that forms the top of the stub 12 mixes and integrates with the incoming molten metal 19. Alternatively, at least a part of the top portion 15 may be melted with a suitable heat source such as an electron beam gun, plasma torch or electric arc, prior to the molten metal 19 being introduced and mixed with the stub 12. The bottom block 20 of the mold 14 conducts heat away from the molten mass, and thereby encourages solidification. Accordingly, solidification of the molten mass begins from the bottom of the mold 14 while more molten metal 19 is introduced into the mold 14 over the solidifying mass to build the electrode 10. As is common in electrode formation, following cooling and solidification of the molten metal 19 at the bottom block 20 of the mold 14, the detachable bottom block 20 slowly moves downward (represented by arrow "A" in FIG. 6A) while molten metal 19 is continually added at the top of the mold 14 to maintain the liquid level of the molten metal 19 at the top of the side walls 22. The skilled artisan will appreciate that the bottom block 20 may be moved downward by hydraulic or mechanical means. Typically, a plasma torch 23 or other suitable heat source is used near the top of the mold 14 and provides addition heat in this area to maintain the molten mass in the molten state to prevent premature solidification. As the bottom block 20 moves downward, the locking member 16 prevents the stub 12 from disengaging from the recessed portion 24. Accordingly, the stub 12 "pulls" the forming electrode 10 downward. Through this process, the electrode 10 is grown to the desired size, typically between 15,000–25,000 pounds. Following formation of the electrode 10, the locking member 16 is removed from the first opening 18 and the second opening 26, allowing removal of the electrode 10 having the integrated stub 12 from the mold 14. Such removal of the locking member or members 16 may be accomplished by a secondary locking member and hammer (not shown). The electrode 10 may then be inverted onto a suitable turntable or other suitable support structure for incorporation into the electrode assembly 30, described below.

Figure 8:
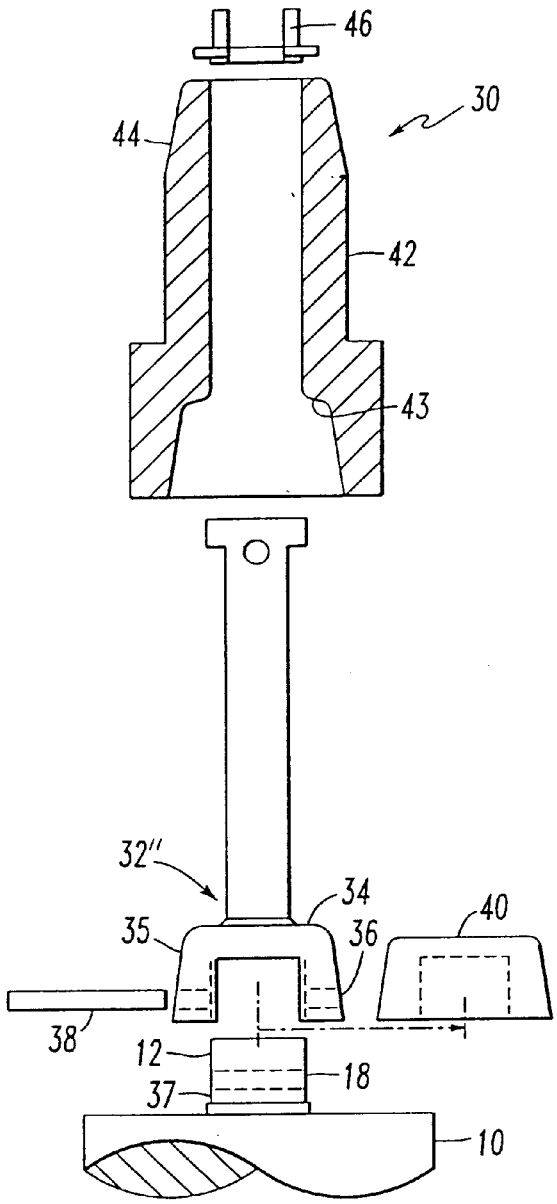
FIG. 8 is an exploded cross-sectional view of the assembly of FIG. 7 rotated 90 degrees.
Figure 9:
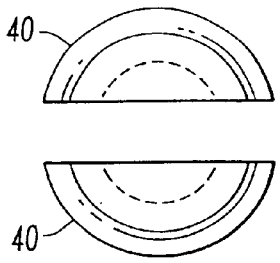
FIG. 9 is a top plan view illustrating the shoes of the present invention.

FIGS. 7–9 illustrate the electrode 10 and integrated stub 12 of the present invention incorporated into the electrode assembly 30 which may be used to facilitate the manipulation of the electrode 10 for further processing applications. The electrode assembly 30 may include the electrode 10 and integrated stub 12, a yoke 32, a fastening member 38, a shoe 40, a current conducting tube 42, and a ejector member 46.

The yoke 32 may be a solid metal shaft having a top portion 32' and a bottom portion 32". The yoke 32 may be formed of any metal capable of withstanding the high melting temperatures associated with continuous casting, such as mild carbon steel, hardened carbon steel, or a more heat resistant material such as a nickel based superalloy, such as, for example, Allvac Alloy 718, manufactured by Teledyne Allvac, Monroe, N.C. The yoke 32 may comprise a one piece machined plate, or a two-piece component joined by any known means in the art, such as, for example, by welding. The top portion 32' may include an orifice 33' for receiving a securing member, such as, for example, a detachable pin member 33 for attachment to a ram of a conventional furnace as described below. The pin 33 may be formed of any metal sufficient to support the weight of the electrode 10, such as, for example, hardened carbon. steel. The bottom portion 32" includes a C-shaped bracket 34 sized to receive the top and side portions of the stub 12 while exposing the stub ends 37. The bracket 34 may have leg members 35, as illustrated. In this form, the bracket 34 and leg members 35 are sized to receive the stub 12 with a small gap therebetween. Bracket openings 36 pass through the leg members 35 and, in the final assembly, correspond to, and are in alignment with, the first opening 18 for attachment to the stub 12.

The fastening member 38 may be a solid metal member having a length approximately, but not necessarily, equal to the width of the bracket 34. The fastening member 38 may be a rod, plate, pin, bar, screw, bolt, clasp, clip, or other fastener that is sized to be received into the openings 36 in the leg members 35 and the first opening 18 to secure the yoke 32 to the stub 12. The fastening member 38 may be made of any heat resistant material known in the art that withstands the relatively high temperatures associated with continuous casting, such as, for example, mild carbon steel, hardened carbon steel, or a more heat resistant material such as a nickel based superalloy, such as, for example, Allvac Alloy 718.

The shoe 40 is an electrical conductor that is placed around the ends 37 of the stub 12 exposed by the bracket 34 and forms an electrical contact between the stub 12 and the conducting tube 42. The. shoe 40 may be any conductive metal such as, for example copper. The shoe 40 may be any shape or configuration that fits over the ends 37 of the stub 12, such as, for example, a two-piece cylinder that has a recess therein for receiving the stub ends 37. When positioned over the stub ends 37, the shoe 40, generally, should not contact the leg members 35 of the yoke 32. In the final assembly, the shoe is held in place over the stub 12 by the current conductive tube 42. See FIGS. 10 and 11. It is contemplated that any number of shoes 40 may be used.

The current conducting tube 42 is a hollow conductive member having a top and bottom portion. The bottom portion includes an inner beveled recess 43 sized to receive the shoes 40 and for making electrical contact therewith. The inner recess 43 may be any shape or configuration, such as, for example, cylindrical, that provides good contact with the shoe 40. When the conducting tube 42 is positioned over the yoke 32, the inner recess 43 receives and makes contact with the shoe 40 as the yoke 32 centrally extends through the hollow portion of the conducting tube 42. The top portion of the conducting tube 42 includes a beveled outer recess 44 that makes contact with the furnace ram, described below. The conducting tube 42 may be formed of any conductive material known in the art that can withstand the compressive forces of the furnace ram and the expansive forces of the shoe 40 such as, for example, mild carbon steel, hardened carbon steel, or titanium.

Figure 10:
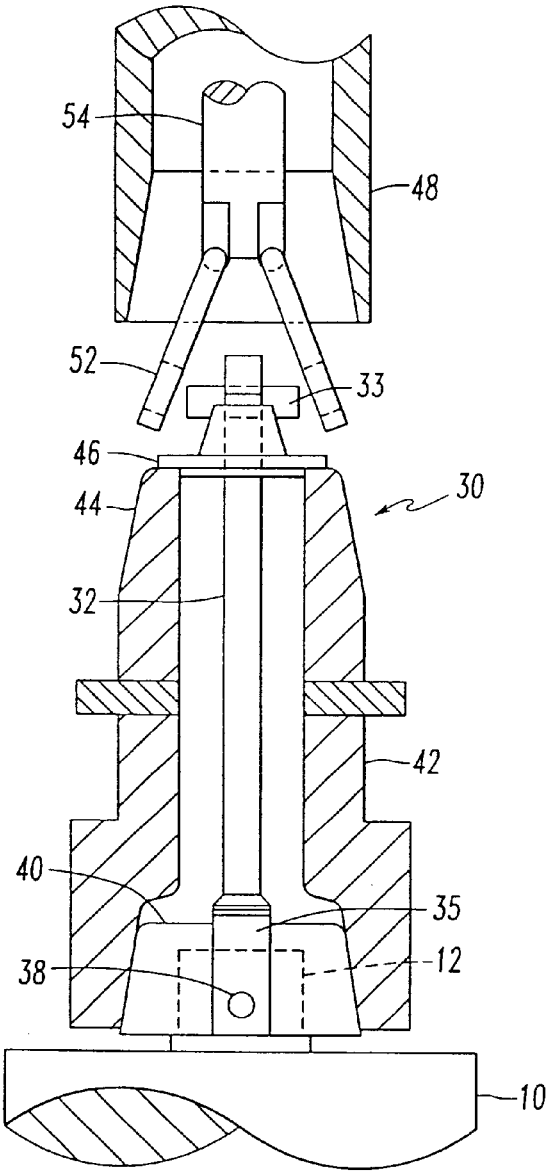
FIG. 10 is a cross-sectional view of the electrode assembly of FIG. 7 ready for attachment to a furnace ram.
Figure 11:
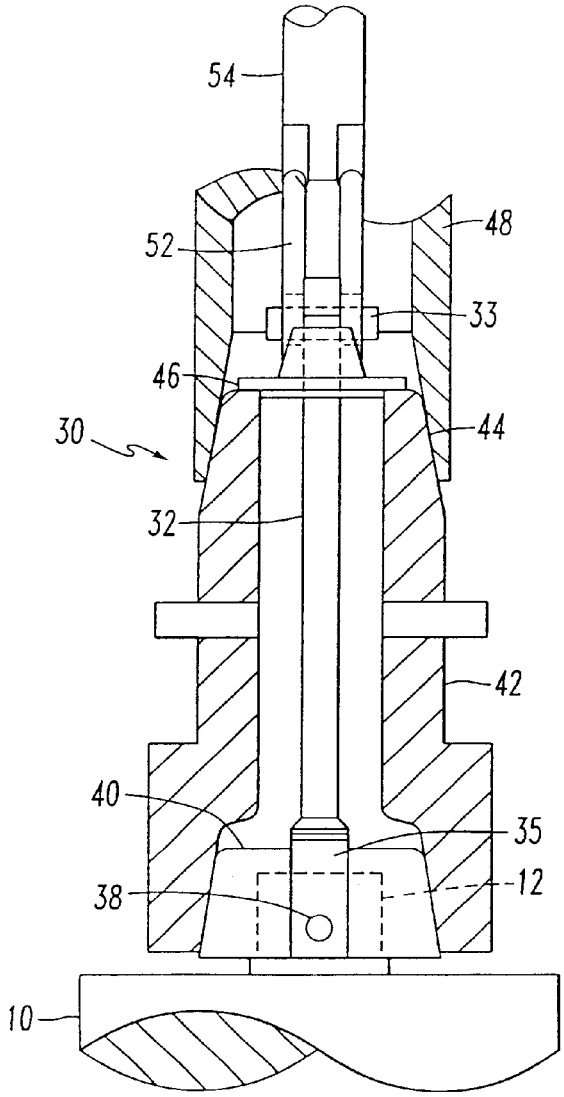
FIG. 11 is a cross-sectional view illustrating the electrode assembly of FIG. 10 attached to a furnace ram.

The ejector member 46 may be any spacing member known in the art for forcing the electrode assembly 30 from the furnace ram after the electrode is re-melted, described below. The ejector member 46 may be, for example, a C-shaped ring extending around the yoke 32 and positioned between the top of the conducting tube 42 and the pin 33 (FIGS. 10 and 11). The ejector member 46 may be formed of any material capable of withstanding the force needed to separate the electrode assembly 30 from the furnace ram, such as, for example, mild carbon steel, hardened carbon steel, and titanium.

It is contemplated that all of the components of the electrode assembly 30 need not have the same shape or configuration to provide good electrical contact or to securely fasten the assembly. For example, it is contemplated that the bracket 34 may have a rectangular cross-section and the stub 12 may be a cylinder having a circular cross-section. Likewise, the inner recess 43 may have a rectangular cross-section and the shoe 40 may be a cylinder having a circular cross-section. If the components have dissimilar shapes or configurations, an adapter or the like (not shown) may be used between components to limit their movement and provide a secure fit therebetween.

It is also contemplated that the stub 12 and the leg members 35 may have more than one opening passing therethrough to facilitate the use of additional locking members for additional locking strength. If additional openings are present, each opening in the stub 12 will typically have a corresponding opening to, and be in alignment with, an opening in the leg members 35 for receipt of fastening member 38.

FIGS. 10 and 11, illustrate the electrode assembly 30 attached to a ram 48 of a conventional vacuum arc re-melt (VAR) furnace. The yoke 32 is lowered onto the stub 12 and the fastening member 38 is inserted through opening 36 in the leg members 35 and the first opening 18 of the stub 12. The shoe 40 is placed around the stub 12 and the current conducting tube 42 is lowered onto the yoke 32 exposing pin 33 out of the top of the conducting tube 42. The ejector member 46 is placed between the top of the conducting tube 42 and the pin 33. As is well known in the art, legs 52 of the furnace ram 48 are pulled over the pin 33, while tubular member 54 is moved upward by a hydraulic cylinder (not shown) to pull the electrode assembly 30 into the furnace ram 48, preventing further upward movement of the electrode assembly. In operation, when a crane grasps the top of the yoke 32, the electrode assembly 30 self-centers under the weight of the electrode 10. The assembly 30 is then placed into a vacuum arc remelting furnace, electroslag remelting furnace, or other type furnace whereby current passes through the electrode 10 for re-melting. The majority of the current travels from the furnace ram 48, into the beveled outer recess 44 of the conducting tube 42, down the conducting tube 42, into the shoe 40, into the stub 12, and into the electrode 10. After the re-melting operation is complete, the electrode assembly 30 is detached from the furnace ram 48. The ejector member 46 forces the release of the conducting tube 42 from the furnace ram 48 before the shoe 40 releases from the conducting tube 42 to eject the electrode assembly 30 from the furnace ram 48 upon completion of the re-melting process. The electrode assembly 30 may then be disassembled in reverse order.

Those of ordinary skill in the art will readily appreciate that re-melting the electrode 10 at high electrical currents may cause overheating of the electrode assembly components. The actual sustainable current limits depends on a number of factors, including the nature of the metal being re-melted, the electrode weight, the cooling effect on the mold, and the gas or vacuum environment and on the overall heat transfer balance in the system. The material selection for each component affects the load carrying capability at elevated temperatures as well as the interaction with electromagnetic fields.

The present invention provides an efficient and cost effective electrode assembly for vertical continuous casting processes. The locking assembly 8 allows for easy release of the sacrificial stub 12 from the mold 14. During conventional continuous electrode casting into a stationary mold, the streaks of molten metal run down along the surface of the electrode and form "icicles" or "rundowns" that act to latch the formed electrode to the dovetail. These "rundowns" must be mechanically removed or broken in order to release the electrode from the dovetail. The sacrificial stub 12 of the present invention does not have any surfaces at an angle to the casting axis. Accordingly, any "rundowns" need not be removed in order to release the electrode 10 from the mold 14. As a result, the present invention eliminates the need for mechanically removing (chiseling) the solidified streaks of metal on the sides of the electrode, and effectively replaces the traditional dovetail mechanism.

Moreover, the stub 12 may include a smooth machined surface that provides good electrical contact for conducting high re-melting current. Because the stub 12 has a smooth outer surface, the stub 12, in combination with the electrode assembly 30 herein disclosed, can be used to introduce current into the electrode. The opening 18 in the stub 12 allows a load needed for maintaining the tight contact of the current conducting surfaces to be applied. The opening 18 also allows easy gripping and positioning of the electrode 10 in a re-melting furnace. If properly machined from the electrode 10 after re-melting, the stub 12 can be reused.

The present invention provides excellent co-axiality between the stub 12 and the electrode 10, particularly when compared to the co-axiality achieved by conventionally welding a stub to a pre-cast electrode. The interface area between the stub 12 and the electrode 10 of the present invention is of the same quality as the electrode 10, whereas conventional welding (either through metal inert gas (MIG)

welding to the cold electrode in air or in a dedicated chamber) produces a weld area that may absorb oxygen or nitrogen from the environment and form potentially deleterious nitride or oxide particles.

Although the foregoing description has necessarily presented a limited number of embodiments of the invention, those of ordinary skill in the relevant art will appreciate that various changes in the configurations, details, materials, and arrangement of the elements that have been herein described and illustrated in order to explain the nature of the invention may be made by those skilled in the art, and all such modifications will remain within the principle and scope of the invention as expressed herein in the appended claims. In addition, although the foregoing detailed description has been directed to embodiments of the continuous casting of metal electrodes in the form of vertical continuous casting in a stationary mold, it will be understood that the present invention has broader applicability and may be used in connection with continuous casting of electrodes for use in additional applications. All such additional applications of the invention remain within the principle and scope of the invention as embodied in the appended claims.

What is claimed is:

1. An apparatus for manipulating an electrode, the apparatus comprising:

a stub protruding from the electrode and said affixed thereto, at least one shoe having a first opening;

a yoke sized to receive at least a portion of the stub, and having a second opening positioned for alignment with the first opening of the stub and receipt of a locking member extending through the first opening and the second opening;

a current conducting tube in electrical contact with the stub; and at least one shoe in contact with the stub.

2. The apparatus of claim 1, wherein the first opening extends through the stub.

3. The apparatus of claim 1, wherein the stub is formed of a titanium alloy.

4. The apparatus of claim 1, wherein the locking member is a cylindrical rod.

5. The apparatus of claim 4, wherein the locking member is a metal selected from the group consisting of mild carbon steel, hardened carbon steel, and titanium.

6. The apparatus of claim 1, wherein the current conducting tube extends around at least one exposed portion of the stub to establish an electrical connection between the stub and the current conducting tube.

7. The apparatus of claim 1, wherein the yoke further comprises a bottom portion sized to receive the portion of the stub therein such that other portions of the stub are exposed, the bottom portion having the second opening positioned therein.

8. The apparatus of claim 7, wherein the shoe is sized to extend around at least one exposed portion of the stub for electrical contact therewith, the current conducting tube having a passage extending therethrough for receiving the yoke therein, the passage being configured to receive the shoe such that an electrical connection is established between the current conducting tube and the shoe.

9. The apparatus of claim 8, further comprising an ejector member adjacent to the current conducting tube.

10. An apparatus for manipulating an electrode, the apparatus comprising:

a stub protruding from the electrode and affixed thereto;

an elongated yoke extending around at least a portion of the stub and removably pinned thereto;

a current conducting tube extending around the elongated yoke and in electrical contact with the stub; and at least one shoe extending around at least one exposed portion of said stub and establishing an electrical connection between the stub and the current conducting tube.

11. The apparatus of claim 10 wherein the stub has a first opening extending therethrough, and wherein the elongated yoke further comprises:

a bottom portion sized to receive a portion of the stub therein such that other portions of the stub are exposed;

a second opening through the bottom portion aligned with the first opening when the portion of the stub is received in the bottom portion; and a locking member extending through the first opening and the second opening.

12. A method for manipulating and applying an electrical current to an electrode comprising:

affixing a stub to the electrode, the stub having a first opening;

removably attaching a yoke to the stub, the yoke having a second opening positioned therein such that the first opening of the stub and the second opening of the yoke may receive a locking member when the first opening and the second opening are aligned;

establishing an electricity conducting path between the stub and a source of electricity; and positioning a shoe to extend around at least one exposed portion of the stub for electrical contact therewith.

13. The method of claim 12, wherein removably attaching the yoke to the stub further comprises receiving a portion of the stub in a bottom portion of the yoke such that other portions of the stub are exposed.

14. The method of claim 12, further comprising positioning a current conducting tube having a passage therethrough to receive the yoke and the shoe such that an electrical connection is established between the current conducting tube and the shoe.

15. The method of claim 12 wherein the source of electricity comprises a furnace ram constructed to grip a portion of the yoke.

16. The method of claim 15 wherein the establishing comprises placing a hollow conducting tube between the stub and the ram.

17. A method for manipulating an electrode comprising:

affixing a stub to the electrode;

extending an elongated yoke around at least a portion of the stub;

removably pinning the yoke to the stub, wherein removably pinning the yoke to the stub further comprises receiving a portion of the stub in a bottom portion of the yoke such that other portions of the stub are exposed;

extending a current conducting tube around the elongated yoke such that the current conducting tube is in electrical contact with the stub, and positioning a shoe to extend around at least one exposed portion of the stub for electrical contact therewith.

* * * * *